United States Patent [19]

Miura

[11] 4,165,580

[45] Aug. 28, 1979

[54] FLYING TOY

[76] Inventor: Motoshi Miura, 1127-1 Kido-cho, Ogaki-shi, Gifu-ken, Japan

[21] Appl. No.: 845,943

[22] Filed: Oct. 27, 1977

[30] Foreign Application Priority Data

Nov. 5, 1976 [JP] Japan ..... 51-149403[U]

[51] Int. Cl.[2] ..... A63H 27/14

[52] U.S. Cl. ..... 46/74 R; 46/83; 124/5

[58] Field of Search ..... 46/74, 75, 82, 83, 84; 124/5

[56] References Cited

U.S. PATENT DOCUMENTS

| | | | |
|---|---|---|---|
| 1,573,527 | 2/1926 | Simonek | 46/83 |
| 2,938,300 | 5/1960 | Newbert et al. | 46/83 |

FOREIGN PATENT DOCUMENTS

| | | | |
|---|---|---|---|
| 464885 | 7/1951 | Italy | 46/75 |

*Primary Examiner*—Louis G. Mancene
*Assistant Examiner*—Robert F. Cutting
*Attorney, Agent, or Firm*—Kenyon & Kenyon

[57] ABSTRACT

A flying toy having disc- or dish-shaped configuration and provided with a polygonal hole in the bottom surface of the flying toy at a position offset from the center thereof. The driving shaft of a launching device is inserted into the hole to rotate and fly the flying toy.

8 Claims, 3 Drawing Figures

FLYING TOY

BACKGROUND OF THE INVENTION

This invention relates to a flying toy and more particularly a disc- or dish-shaped flying toy capable of flying in any desired direction.

In a well-known flying toy of this type, there is provided a hole at the central portion of the bottom surface thereof and the driving shaft of an actuating device is inserted into the hole to impart rotation to the flying toy. However, since such flying toy is generally rotated about the central axis thereof, it is impossible to fly the toy in any desired direction of the flying course. For example, regarding a known dish-shaped flying toy such as U F O (unidentified flying object) toy, the player cannot fly it in any desired direction since it can be flown only upwardly.

SUMMARY OF THE INVENTION

Accordingly, an object of this invention is to provide an improved flying toy which can be flown in any desired direction over a long flight time and flight distance.

According to the present invention, there is provided a flying toy having disc- or dish-shaped configuration and provided with a hole in the bottom surface thereof adapted to receive the driving shaft of a launching device for imparting rotation to the toy, said hole, according to the improvement of the invention, being provided in the bottom surface of the toy at a position offset from the center thereof.

The other objects and advantages of the present invention will be more readily understood from the following detailed description taken in conjunction with the accompanying drawing.

DESCRIPTION OF THE PREFERRED EMBODIMENT

Figure 1:
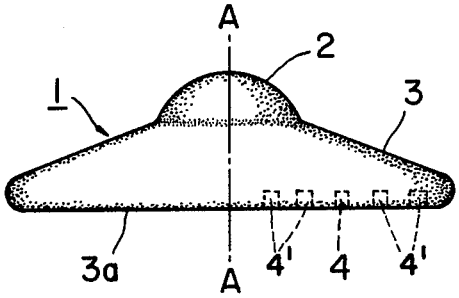
FIG. 1 is a front view of the flying toy according to this invention.
Figure 2:
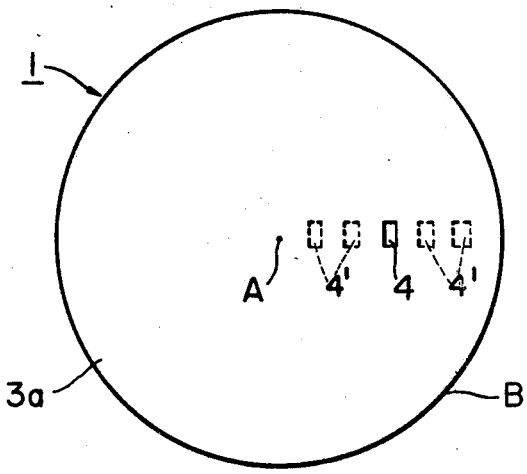
FIG. 2 is a bottom view of the flying toy shown in FIG. 1.

Referring to FIGS. 1 and 2, there is shown a disc-or dish-shaped flying toy 1 which is made of a light material suitable for flight, such as a synthetic resin, foam plastics, a thin plate of light metal, a thick paper or the like. The flying toy 1 is constructed symmetrically about the central axis A—A thereof. In the illustrated embodiment of the invention, the flying toy comprises a top portion 2 which is substantially in the form of a hemisphere, and a lower portion 3 which is formed in frustconical shape.

In the bottom surface 3*a* of the lower portion 3, there is provided a polygonal hole 4 which is offset from the axis A—A or the center A of the bottom surface as clearly shown in FIG. 2. The hole 4 is adapted for engagement with a polygonal driving shaft of a launching device as will be described in detail hereinbelow.

Figure 3:
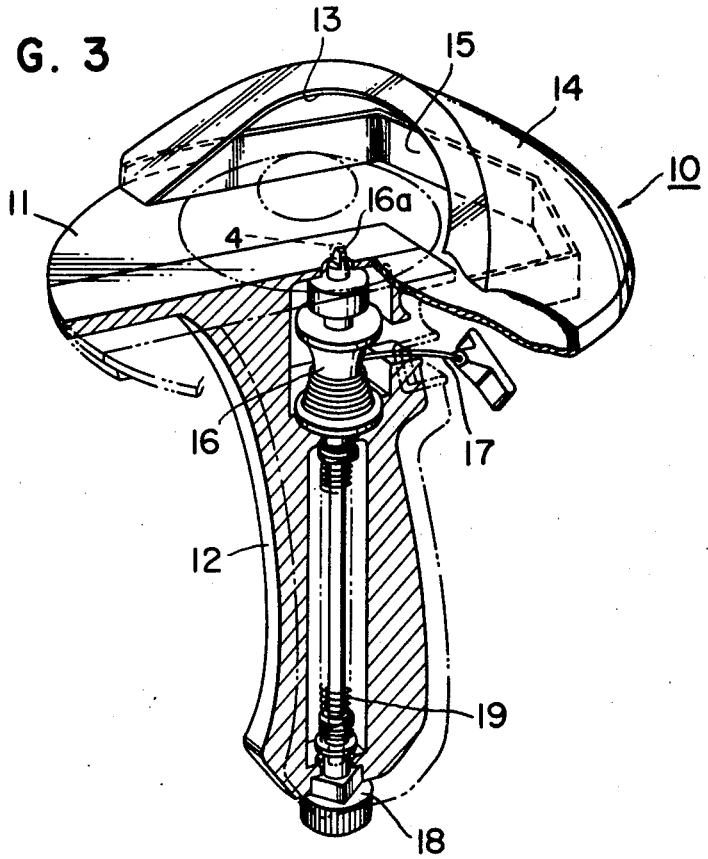
FIG. 3 is a perspective view, with a part broken away, of a launching device for rotating and flying the toy according to this invention.

FIG. 3 shows one example of the launching device, which is generally designated by reference numeral 10, for rotating and flying the flying toy 1 of this invention.

The launching device 10 comprises a disc-shaped launching plate 11, a grip 12 attached to the lower surface of the lauching plate 11 and a dome 14 disposed above the plate 11 and provided with an opening 13, the dome 14 serving as a safety cover to prevent the toy 1 from flying out backwardly. The device 10 is further provided with a generally U-shaped reflecting plate 15 secured to the peripheral portion of the lauching plate 11 so as to partially surround the center thereof.

The driving shaft referred to hereinabove is designated at 16 and is rotatably disposed in the interior of the grip 12 and the top end 16*a* of the shaft projects from the upper surface of the launching plate 11 to be detachably engaged with the hole 4 of the bottom surface 3*a* of the flying toy 1. The driving shaft 16 can be rotated by manually pulling a string 17 which is wound up or coiled around the peripheral surface of the shaft 16. Between the lower end of the shaft 16 and a plug 18, spring means 19 is fitted so that the string 17 will be wound up again on the shaft by the action of the spring 19 after the flight of the toy 1.

The operation of the flying toy embodying this invention will be described hereunder.

When the driving shaft 16 of the launching device 10 is rotated by manually pulling the string 17, the flying toy 1 engaged with the top end 16*a* of the shaft through the polygonal hole 4 is also rotated, but since the hole is provided offset from the center A of the bottom surface 3*a* of the flying toy, the toy is rotated eccentrically. This eccentric rotation enlarges the locus of the peripheral edge B of the rotating toy 1 and increases the centrifugal force thereof. The flying toy 1, accelerated by the rotation of the driving shaft 16, leaves from the top end 16*a* due to Coriolis force, flies outwardly in a radial direction by centrifugal force and off through the opening 13 of the dome 14, either directly or after collision with the reflecting plate 15.

Because of the enlarged locus of the rotating toy and the increased centrifugal force, the flight time can be increased and the flight distance can also be extended, and since the flying toy can be flown in any desired direction, the player can fully be amused with the toy in the flight.

Furthermore, the flying toy 1 of this invention may be preferably used as a flying target of trap shooting in combination with a launching device.

If desired, a plurality of polygonal holes 4' may be provided near the center A and near the peripheral edge B of the bottom surface 3*a* of the toy for selectively using one of the holes in conformity with the weather conditions and/or the surrounding terrain, and the peripheral edge B of the lower portion 3 and the wall of the hole 4 of the bottom surface of the toy may also be reinforced as occasion demands by a material slightly harder than the other portion of the flying toy.

I claim:

1. In a flying toy having disc-shaped or dish-shaped flying object symmetrical about an axis through the center of the disc and provided with means at the bottom thereof adapted to releasably engage a rotatable driving member of a launching device for imparting rotation to the flying object, the improvement wherein said engaging means at the bottom of the flying object is located at a position offset from the axis of symmetry, the object being adapted to be rotated eccentrically about an axis through said offset position parallel to the axis of symmetry when said means is engaged with a rotatable drive member of a launching device.

2. The flying toy according to claim 1, wherein said hole is of a polygonal cross section.

3. The flying toy according to claim 1, wherein said offset means at the bottom of the flying object adapted to releasably engage a rotatable driving member is positioned near the central axis of the flying object.

4. The flying toy according to claim 1, wherein said offset means at the bottom of the flying object adapted to releasably engage a rotatable driving member is positioned near the peripheral edge of the bottom surface of the flying object.

5. The flying toy according to claim 1 wherein said means at the bottom of the flying object adapted to releasably engage a rotatable driving member is a non-circular hole in the bottom surface of the flying object.

6. The flying toy according to claim 1 comprising a plurality of means at the bottom of the flying object adapted to releasably engage a rotatable driving member located at a corresponding plurality of radially spaced positions from near the central axis to near the edge of the disc-shaped flying object.

7. The flying toy according to claim 1 further comprising a launching device, the launching device comprising:

a planar launching platform;

a driving member centrally located and rotatable with respect to said platform and releasably engageable with the offset engaging means at the bottom of the flying object when the object is resting on the launching platform for eccentrically rotating the object about an axis through said offset position parallel to the central axis of said object; and a circumferential reflecting wall on the launching platform, the wall partially surrounding the driving member outside the locus described by the peripheral edge of the object when rotated by said driving member, the wall having an opening large enough to permit launching of the flying object therethrough.

8. The flying toy according to claim 7 wherein the launching device further comprises a dome-shaped safety cover attached to the launching platform, the safety cover having an opening aligned with the opening in the reflective wall large enough to permit passage of the flying object.

* * * * *